United States Patent [19]

Aihara

[11] Patent Number: 4,901,294

[45] Date of Patent: Feb. 13, 1990

[54] ELECTRONIC TIME MEASURING APPARATUS INCLUDING ACOUSTIC DATA RECORDING/REPRODUCING FUNCTIONS

[75] Inventor: Fumikazu Aihara, Kita, Japan

[73] Assignee: Casio Computer Co., Ltd., Tokyo, Japan

[21] Appl. No.: 403,136

[22] Filed: Sep. 5, 1989

[30] Foreign Application Priority Data

Sep. 7, 1988 [JP] Japan ..... 63-117569

[51] Int. Cl.[4] ..... G04B 21/08; G04F 8/00

[52] U.S. Cl. ..... 368/63; 368/111; 368/113

[58] Field of Search ..... 368/63, 107–113, 368/72–74, 250, 251

[56] References Cited

U.S. PATENT DOCUMENTS

| | | | |
|---|---|---|---|
| 4,368,988 | 1/1983 | Tahara et al. | 368/63 |
| 4,405,241 | 9/1983 | Alhara et al. | 368/63 |
| 4,406,549 | 9/1983 | Takahashi | 368/63 |
| 4,545,686 | 10/1985 | Ushikoshi | 368/63 |
| 4,589,779 | 5/1986 | Hatta et al. | 368/74 |
| 4,831,605 | 5/1989 | Suga | 368/113 |

*Primary Examiner*—Vit W. Miska

*Attorney, Agent, or Firm*—Frishauf, Holtz, Goodman & Woodward

[57] ABSTRACT

In an electronic time measuring apparatus combined with a timepiece, acoustic data such as voice information related to the time measurements can be recorded in relation to the measured time data, for instance, split times and lap times the electronic time measuring apparatus includes: a time measuring circuit for counting a reference signal so as to obtain time data; a display unit for displaying the time data acquired by the time measuring circuit; a start/stop controlling circuit for controlling a start/stop of the counting operation for the reference signal by the time measuring means; a switch operable while the counting operation by the time measuring circuit is carried out under the control of the start/stop control means; an intermediate time data memory for storing intermediate time data measured by the time measuring circuit when the switch operation by the switch is performed; a recording circuit coupled to the switch, capable of recording acoustic information externally supplied thereto when the switch is operated; a display controlling circuit for controlling the display unit to display thereon the time data which has been stored in the intermediate time data memory; and a reproducing unit for reproducing the acoustic information which has been recorded by the recording unit while the time data stored in the intermediate time data memory is displayed by the display means under the control of the display controlling circuit.

14 Claims, 2 Drawing Sheets

ELECTRONIC TIME MEASURING APPARATUS INCLUDING ACOUSTIC DATA RECORDING/REPRODUCING FUNCTIONS

BACKGROUND OF THE INVENTION

1. Field of the Invention

The present invention generally relates to electronic time measuring apparatus for measuring a time by counting a reference signal. More specifically, the present invention is directed to an electronic time measuring apparatus having acoustic data recording/reproducing functions.

2. Description of the Related Art

Various types of conventional electronic time measuring apparatuses, or electronic timepieces have been widely developed, by which not only a total time is measured from a measurement time instance till a stop time instance, but also so-called "split time" and also "lap time" can be stored into an internal memory as an elapsed time after starting the time measurement. These conventional electronic time measuring apparatuses are described in, for instance, U.S. Pat. No. 4,831,605 issued to F. Suga, entitled "ELECTRONIC TIME MEASURING APPARATUS INCLUDING PAST RECORD DISPLAY MEANS".

While such known time measuring apparatuses are used, in addition to the above-described split time and lap time measurements, various time measuring conditions are required to be recorded therein. These time measuring conditions includes, for instance, a place where either a split time, or lap time has been recorded; a physical condition and form of a runner to be time-measured; and a weather condition when a time is measured. In such a condition, the various conditions when the measurement is carried out are written on paper by a runner, or other persons. Otherwise, these conditions are recorded by utilizing such a recording/reproducing apparatus as described in U.S. Pat. No. 4,368,988 issued to I. Tahara et al., entitled "ELECTRONIC TIMEPIECE HAVING RECORDING FUNCTION". However, it is very difficult to store the abovedescribed various data by way of the key input operations during the time measurement, because a certain time is required for the key input operations and also cumbersome operations are needed. In particular, in case that the time-measurement condition recording is carried out many times within a shorter time period, the time measuring operation itself may be mistakenly performed, and the correct time measurements may not be carried out at desired measuring time instances. Also, in case of a large quantity of recording operation, a relationship between an elapsed time which has been recorded and a recording condition may be confused.

SUMMARY OF THE INVENTION

The present invention has been made in an attempt to solve the above-described drawbacks of the conventional electronic time measuring apparatuses, and therefore has an object to provided an electronic time measuring apparatus capable of simply storing therein data required for time measurements even during the time measurement operation.

To achieve the above-described object, an electronic time measuring apparatus according to the present invention comprises:

time measuring means for counting a reference signal so as to obtain time data;

display means for displaying said time data acquired by said time measuring means;

start/stop controlling means for controlling a start/-stop of the counting operation for said reference signal by said time measuring means;

switch means operable while the counting operation by said time measuring means is carried out under the control of said start/stop control means;

intermediate time data memory means for storing intermediate time data measured by said time measuring means when the switch operation by said switch means is performed;

recording means coupled to said switch means, capable of recording acoustic information externally supplied thereto when said switch means is operated;

display control means for controlling said display means to display thereon the time data which has been stored in said intermediate time data memory means; and reproducing means for reproducing the acoustic information which has been recorded by said recording means while the time data stored in said intermediate time data memory means is displayed by the display means under the control of the display control means.

In the electronic time measuring apparatus according to the invention, since not only various information related to the time measurement can be simply recorded as the acoustic data even during the time measuring operation, but also the recorded information can be acoustically output when the measured intermediate time data is displayed, the recorded information can be surely recognized without any error, or misunderstanding.

BRIEF DESCRIPTION OF THE DRAWINGS

For a better understanding of the present invention, reference is made to the following descriptions in conjunction with the accompanying drawings, in which.

DETAILED DESCRIPTION OF THE PREFERRED EMBODIMENTS

CIRCUIT ARRANGEMENT OF ELECTRONIC TIME MEASURING APPARATUS

Figure 1:
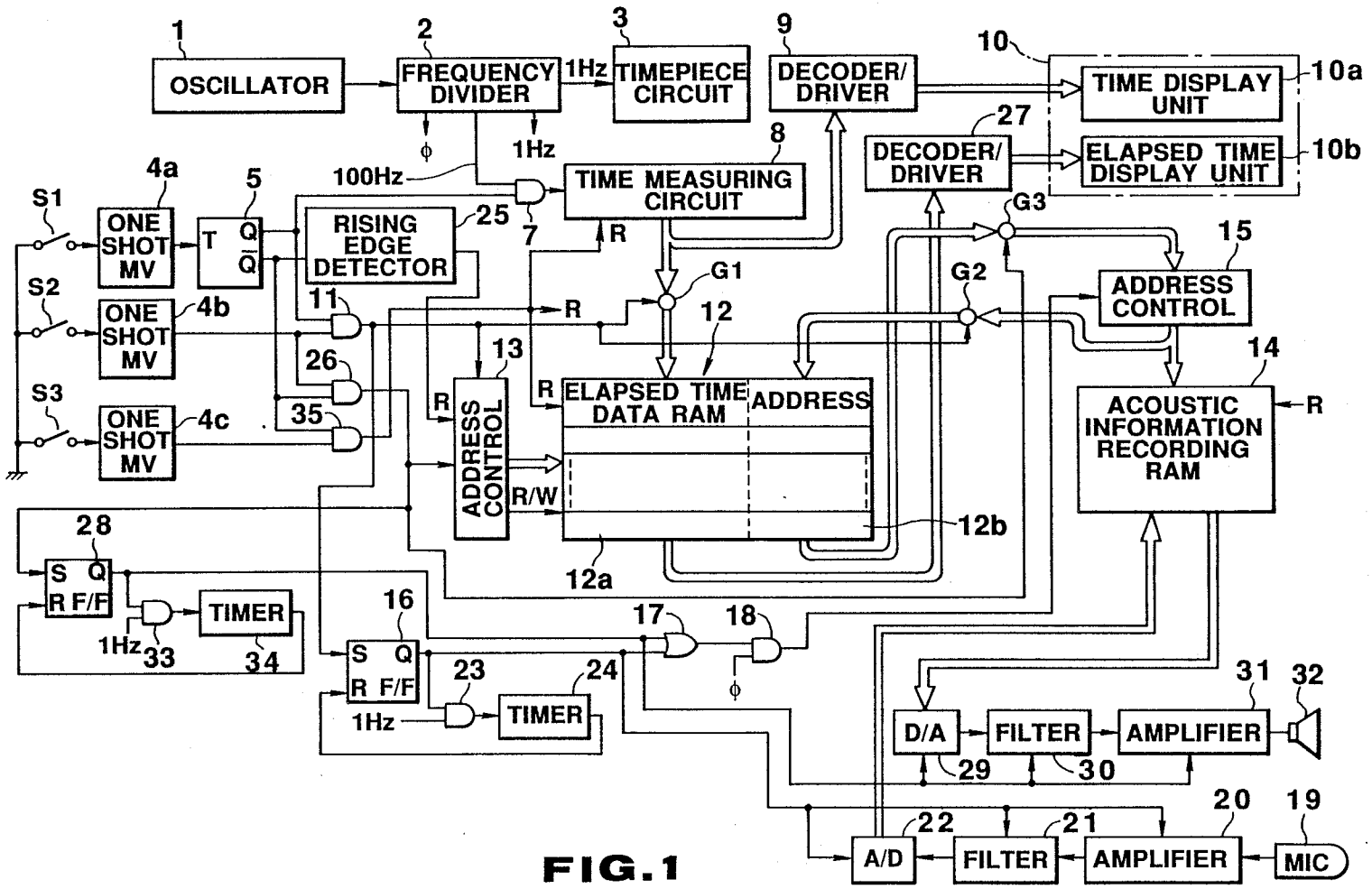
FIG. 1 is a schematic block diagram of an electronic time measuring apparatus according to a preferred embodiment of the present invention; and, FIG. 2 is a schematic block diagram of an electronic time measuring apparatus according to another preferred embodiment.

In FIG. 1, there is shown a circuit arrangement of an electronic time measuring apparatus according to a first preferred embodiment of the present invention.

In the electronic time measuring apparatus shown in FIG. 1, an oscillation signal derived from an oscillator circuit 1 is frequency-divided in a frequency dividing circuit 2. The function of this frequency dividing circuit 2 is to divide the oscillation signal so as to produce a clock pulse $\phi$, a 100 Hz-signal, and 1 Hz-signal. The 1 Hz-signal output from this frequency dividing circuit 2 is transferred to a timepiece circuit 3. This timepiece circuit 3 counts the 1 Hz-signal and display present time data such as an hour, a minute, a second and the like, which are obtained by counting the 1 Hz-signal. The 100 Hz-signal output from the frequency dividing circuit 2 is transferred via an AND gate 7 to a time measuring circuit 8. The function of this time measuring circuit 8 is to count the 100 Hz-signal output from the AND gate 7 in order to obtain time data. This time data is sent to a gate G1 and displayed in a digital form on a time display unit 10*a* of a display unit 10 constructed of a liquid crystal display apparatus after being processed in a decoder/driver circuit 9.

A switch S1 functions as a switch for changing a start or stop of a time measurement, and also as another switch for changing a recording mode or reproducing mode of acoustic information. Every time this switch S1 is operated, a one-shot multivibrator circuit 4*a* outputs a one-shot pulse and inputs this one-shot pulse to a trigger terminal "T" of a trigger flip-flop 5. That is, every time a switch S1 is operated, both a Q-output and a $\overline{Q}$-output from a flip-flop 5 are alternately changed between a high level and a low level. As a results, the above-described changing operations between a start and a stop of the time measurement, and between the recording mode and reproducing mode are carried out. Another switch S2 is to commence the memory operations of the measured elapsed times and the recording operations of the acoustic information. A one-shot pulse is output from a one-shot multivibrator circuit 4*b* every time this switch S2 is operated. A switch S3 corresponds to a clear switch for erasing all of the measuring data, measured elapsed time, and recording data. A one-shot pulse is output from a one-shot multivibrator circuit 4*c* every time this third switch S3 is manipulated.

When the Q-output of the flip-flop 5 is switched to a high level by operating the switch S1, the time measurement is commenced and thus the time measuring mode has just been set. That is, the 100 Hz-reference signal derived from the frequency dividing circuit 2 is supplied via the AND circuit 7 to which the abovedescribed high-leveled Q-output has been input from the flip-flop 5, to the time measuring circuit 8. Then, the time measuring circuit 8 counts this 100 Hz-reference signal. As a result, the measured time data constructed of an hour, a minute, a second, and 1/100 seconds which have been calculated from this time measuring circuit 8, are displayed on the time display unit 10*a* of the display unit 10 under the control of the decoder/driver 9.

When the switch S2 is operated under the time measuring mode, the time data which are measured time to time by the time measuring circuit 8 are stored into the intermediate time memory RAM 12. In other words, the one-shot pulse output from the one-shot circuit 4*b* when the switch S2 is operated is supplied via the AND circuit 11 into which the high-leveled Q output of the flip-flop 5 has been input to gates G1 and G2, and also supplied to an address control unit 13 of RAM 12. As a consequence, the time measurement data output from the time measuring circuit 8 åre supplied via the gate G1 to RAM 12 and written therein as the elapsed time data. At the same time, address data of an address control unit 15 for addressing an acoustic information recording RAM 14 is supplied via the gate G2 to RAM 12 and written therein. The above-described RAM 12 is arranged by a time data memory region 12*a* for storing the elapsed time data which is supplied via the gate G1, and also an address data memory region 12*b* for storing the address information which is supplied via the gate G2. Both these time data and address information are stored in one-to-one relationship in this RAM 12.

The one-shot pulse output from the one-shot circuit 4*c* is input into a set input terminal "S" of an R-S type flip-flop via the AND circuit 11. As a result, the flip-flop 16 is set and the Q-output thereof is changed into the high level. Since this high-leveled signal is input via an OR circuit 17 to an AND circuit 18, the clock pulse signal $\phi$ having a predetermined frequency which has been output from the frequency dividing circuit 2 so as to increase the address, is supplied via the AND circuit 18 to the address control unit 15. As a result, the address of the acoustic information recording RAM 14 is sequentially updated.

ACOUSTIC RECORDING MODE

On the other hand, the high-leveled Q-output of the flip-flop 16 is also supplied as a recording operation instruction signal to an amplifier 20 for an acoustic input, a filter 21 and an A/D (analog-to digital) converting circuit 22. Thus acoustic information externally supplied is first converted into an acoustic signal by a microphone 19, secondly amplified by amplifier 20, and thereafter only the acoustic signal having a desired frequency component is filtered by a filter 21. Subsequently, the filtered acoustic signal is A/D-converted into corresponding digital acoustic data by the A/D converting circuit 22. Then, the digital acoustic data are sequentially written into RAM 14 in accordance with the addressing operations by the address control unit 15.

In case that this RAM 14 is so arranged as to store, for instance, 5 pieces of time data into the time data memory region 12*c* of RAM 12, the memory capacity thereof is to store 10-second acoustic data per one piece, namely 50-second acoustic data in total in the time data memory region 12*a*.

Since the high-leveled Q-output of the flip-flop 16 is also supplied to the AND circuit 23, the above-described 1 Hz-signal derived from the frequency dividing circuit 2 is supplied via the AND circuit 23 to a timer 24 which is counted up by, for instance, 10 seconds. After 10 seconds have passed, when the timer 24 outputs a time up signal, this time up signal is input to a reset terminal "R" of the flip-flop 16. As a result, the flip-flop 16 is reset and the Q-output thereof is changed into the low level, so that the supply of the addressing signal $\phi$ which has been supplied to the address control unit 15 is stopped, and also the supply of the recording instruction signal which has been supplied to the amplifier 20, filter 21, and A/D converting circuit 22 is ceased. As a result, the above-described recording operation is stopped.

As previously described, when the switch S2 is operated in the time measuring mode, the measured time data of the time measuring circuit 8 are successively stored as the elapsed time data in the time data memory area 12*a* every time this switch S2 is operated, during which the recording operation can be performed for 10 seconds. The first addresses of the respect recorded data are stored in the address information memory region 12*b* of RAM 12 which corresponds to the time data memory region 12*a*.

REPRODUCING MODE

Then, when the switch S1 is operated under the above-described time measuring condition, the Q-output of the flip-flop 5 is changed into the low level so that the time measuring operation by the time measuring circuit 8 is interrupted and thus the reproduction mode is in operative. That is, the rising edge of the $\overline{Q}$-output of the flip-flop 5 is detected by a rising edge detecting circuit 25, and the detecting signal thereof is supplied to the reset terminal of the address control unit 13. As a consequence, the address data of the address control unit 13 is returned to zero. In other words, the first address region of RAM 12 is designated.

When the switch S2 is operated under this reproduction mode, the elapsed time data are displayed and the recorded acoustic data corresponding to these elapsed time data are reproduced. First, the one-shot pulse which has been output from the one-shot multivibrator circuit **4*b* in response to the operation of the switch S2, is supplied via the AND circuit 26 to the address control circuit 13, into which the high-leveled $\overline{Q}$-output of the flip-flop 5 has been input, and also to the gate G3. As a consequence, both the elapsed time data stored in the time data memory region 12*a* of RAM 12 which has been designated by the address control unit 13, and the address information stored in the address information memory region 12*b* are read out. The elapsed time data is displayed on the elapsed time display unit 10*b* under the control of the decoder/driver 27, whereas the address information is supplied via the gate G3 to the address control unit 15** and preset therein.

At the same time, the one-shot pulse output from the one-shot multivibrator circuit **4*b* is input via the AND circuit 26 to a set input terminal of the S type flip-flop 28. Then, the flip-flop 28 is set and the Q-output thereof is changed into the high level signal. As a result, since this high-leveled signal is input via the OR circuit 17 to the AND circuit 18, the addressing signal $\phi$ is furnished via the AND circuit 18 to the address control circuit 15. Therefore, the addresses of RAM 14 are successively designated as to first address which has been preset to the address control unit 15, so that the acoustic data stored in RAM 14 are sequentially read. On the other hand, the high-leveled Q-output of the flip-flop 28 is also input to the D/A converting circuit 29, filter 30, and amplifier 31 as the reproduction instruction signal. Accordingly, the acoustic data which have been successively read from RAM 14 are A/D converted into the analog acoustic signal by the A/D converting circuit 29. After only required frequency signal components of this analog acoustic signal are filtered in the filter 30, these signal components are amplified in the amplifier 31 and output as voice from the speaker 32**.

Since the high-leveled Q-output derived from the flip-flop 28 is also input to the ADD circuit 33, the 1 Hz signal output from the frequency dividing circuit 6 is input as the timer starting circuit to the timer 34 which functions similar to the above-described timer 24 counting up every 10 seconds, for example. Thereafter, when the timer 34 outputs the count-up signal after 10 seconds have passed, this count-up signal is input into the reset terminal "R" of the flip-flop 28. As a consequence, the flip-flop 28 is reset and the Q-output thereof is changed into the low level. Then, the supply of the addressing signal which has been supplied to the address control unit 15 is stopped and the supply of the operation instruction signal which has been furnished to the D/A converting circuit 29, filter 30, and amplifier 31 is similarly stopped so that the abovedescribed reproduction operation is stopped.

As previously explained, when the switch S2 is operated in the reproduction mode, the lap time data stored in RAM 12 are read and displayed one by one every time this switch S2 is operated, whereas the acoustic data which have been stored in RAM 14 is correspond to this lap time is reproduced for 10 seconds.

DATA ERASING

When the clear switch S3 is operated in the reproduction mode, the one-shot pulse output from the one-shot multivibrator circuit **4*c* is input into the respective reset terminals of the time measuring circuit 8, RAM 12 and RAM 14 via the AND circuit 35 to which the high-leveled $\overline{Q}$-output of the flip-flop 5** has been input, whereby all of the above-described data are erased completely.

While has been described, in accordance with the time measuring apparatus according to the preferred embodiment, the following advantages are achieved. That is, every time the elapsed time data is stored by operating the switch S2, the condition under this time measuring operation can be recorded as the acoustic data, or voice, so that the data necessary for the time measurement can be simply recorded even during the flurried time measurements.

MODIFICATIONS

Figure 2:
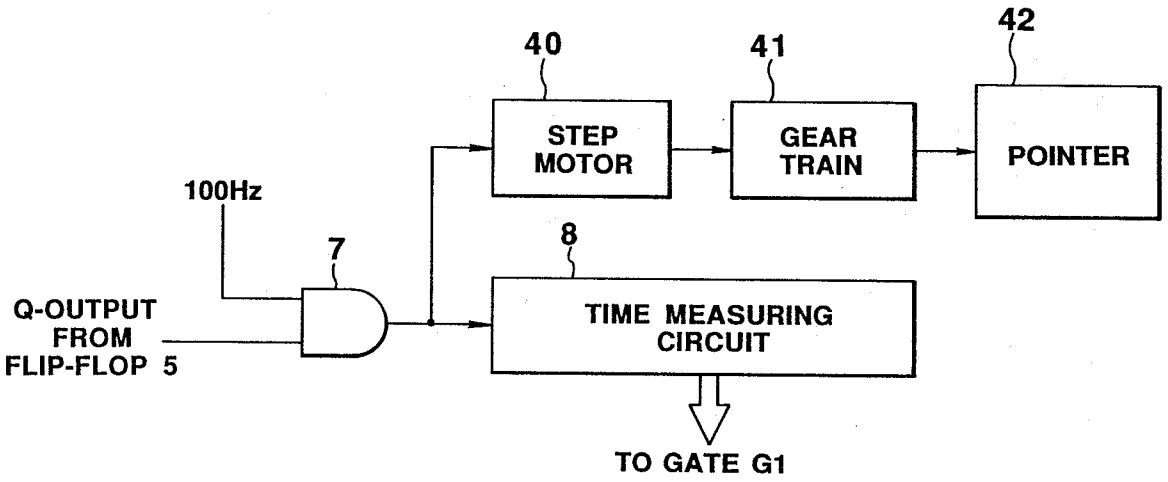

In the above-described preferred embodiment, both the time data measured by the time measuring circuit 8 and the time data derived from RAM 12 were displayed in a digital form on the display units **10*a* and 10*b* constructed of the liquid crystal display device. Alternatively, these time data may be printed out by a printer for display purpose Also it is possible to display such time data by way of not the digital display means, but a pointer. To this end, as illustrated in FIG. 2, the output signal from the AND gate 7 is supplied to a step motor 40 so as to drive this step motor 40 with the result that a gear train mechanism 41 is driven by the step motor 40 and thus the pointer 42 can display the measured time data in an analog form In the above-described RAM 12, the elapsed time data from the starting time instance obtained from the time measuring circuit 8, namely split time data were stored. Alternatively, the time period since the switch S2 was operated in a previous time until the switch S2 is operated at this time, namely a lap time may be stored in RAM 12. It is also possible to display the lap time by calculating the above-described measured elapsed time data. As previously describe in detail, according to the present invention, there is no limitation in the time data which is to be stored in RAM 12. For instance, any types of intermediate time data, namely the time data calculated based upon the time data obtained by the time measuring circuit 8 may be stored in RAM 12**.

What is claimed is:

1. An electronic time measuring apparatus comprising:

time measuring means for counting a reference signal so as to obtain time data;

display means for displaying said time data acquired by said time measuring means;

start/stop controlling means for controlling a start/stop of the counting operation for said reference signal by said time measuring means;

switch means operable while the counting operation by said time measuring means is carried out under the control of said start/stop control means;

intermediate time data memory means for storing intermediate time data measured by said time measuring means when the switch operation by said switch means is performed;

recording means coupled to said switch means, capable of recording acoustic information externally supplied thereto when said switch means is operated;

display control means for controlling said display means to display thereon the time data which has been stored in said intermediate time data memory means; and, reproducing means for reproducing the acoustic information which has been recorded by said recording means while the time data stored in said intermediate time data memory means is displayed by the display means under the control of the display control means.

2. An electronic time measuring apparatus as claimed in claim 1, wherein said intermediate time data memory means includes:

a memory region for storing a plurality of intermediate time data; and said recording means includes:

an acoustic data memory means for storing acoustic data externally provided, the number of which is equal to that of said memory region.

3. An electronic time measuring apparatus as claimed in claim 1, wherein said recording means comprises a semiconductor memory in which the externally provided acoustic data is stored into a memory region addressed by address information.

4. An electronic time measuring apparatus is claimed in claim 1, wherein said recording means comprises a semiconductor memory in which the externally provided acoustic data is stored into a memory region addressed by address information, and said intermediate time data memory means includes:

an intermediate time data memory region for storing the intermediate time data acquired when said switch means is operated; and, an address information memory region for storing the address information of said semiconductor memory when said switch means is operated.

5. An electronic time measuring apparatus as claimed in claim 1, wherein said recording means comprises address designating means for outputting address information, and a semiconductor memory in which externally provided acoustic data is stored into a memory region addressed by the address information output from said address designating means;

said intermediate time data memory means includes:

an intermediate time data memory region for storing the intermediate time data acquired when said switch means is operated; and, an address information memory means for storing the address information of the semiconductor memory when said switch means is operated; and, said reproducing means includes transfer means for transferring the address information which has been stored in the address information memory region to said address designating means of said recording means.

6. An electronic time measuring apparatus as claimed in claim 1, further comprising:

timer means for stopping the recording operation by said recording means after a predetermined time has elapsed.

7. An electronic time measuring apparatus as claimed in claim 1, wherein said display means comprises a liquid crystal display apparatus.

8. An electronic time measuring apparatus as claimed in claim 1, wherein said display means comprises printing means that prints out the time data.

9. An electronic time measuring apparatus as claimed in claim 1, wherein said display means is comprises pointer display means in which a pointer is driven by a step motor.

10. An electronic time measuring apparatus as claimed in claim 1, wherein said display means includes:

first display means for displaying the time data obtained by said time measuring means; and, second display means for displaying the intermediate time data which has been stored in said intermediate time data memory means.

11. An electronic time measuring apparatus as claimed in claim 1, wherein said intermediate time memory means stores, as said intermediate time data, time data acquired by said time measuring means after said counting operation is commenced.

12. An electronic time measuring apparatus as claimed in claim 1, wherein said intermediate time data memory means stores, as said intermediate time data, a difference between the time data of said time measuring means acquired when said switch means is operated, and the time data of said time measuring means acquired when said switch means was operated at a previous measuring operation.

13. An electronic time measuring apparatus as claimed in claim 1, further comprising:

clear means for clearing contents of said time measuring means and of said intermediate time data memory means.

14. An electronic time measuring apparatus as claimed in claim 1, further comprising:

a timepiece circuit for counting a signal having a predetermined time period so as to display a present time.

* * * * *